US008156884B2

(12) United States Patent
Corvalan San Martin et al.

(10) Patent No.: US 8,156,884 B2
(45) Date of Patent: Apr. 17, 2012

(54) VESSEL MOORING SYSTEMS AND METHODS

(75) Inventors: Hugo Antonio Corvalan San Martin, Kuala Lumpur (MY); Yile Li, Katy, TX (US); King Him Lo, Missouri City, TX (US); Joao Paulo Juliao Matsuura, Houston, TX (US)

(73) Assignee: shell Oil Company, Houston, TX (US)

( * ) Notice: Subject to any disclaimer, the term of this patent is extended or adjusted under 35 U.S.C. 154(b) by 78 days.

(21) Appl. No.: 12/664,926

(22) PCT Filed: Jun. 25, 2008

(86) PCT No.: PCT/US2008/068098

§ 371 (c)(1),
(2), (4) Date: May 4, 2010

(87) PCT Pub. No.: WO2009/002995

PCT Pub. Date: Dec. 31, 2008

(65) Prior Publication Data

US 2010/0212570 A1 Aug. 26, 2010

Related U.S. Application Data

(60) Provisional application No. 60/946,661, filed on Jun. 27, 2007.

(51) Int. Cl.
*B63B 21/00* (2006.01)

(52) U.S. Cl. ..... 114/230.2; 114/293; 441/3

(58) Field of Classification Search ..... 114/230.15, 114/230.2, 230.23, 293; 405/223.1, 224, 405/224.1; 441/3, 4, 5

See application file for complete search history.

(56) References Cited

U.S. PATENT DOCUMENTS

| | | | | |
|---|---|---|---|---|
| 3,422,783 | A * | 1/1969 | Moulin | 114/230.23 |
| 5,097,788 | A * | 3/1992 | Castel | 114/293 |
| 5,159,891 | A * | 11/1992 | Lohr et al. | 114/293 |
| 5,944,448 | A | 8/1999 | Williams | 405/169 |
| 6,132,144 | A * | 10/2000 | Zueck et al. | 114/293 |
| 6,408,781 | B1 | 6/2002 | Daniels | 114/293 |
| 6,571,723 | B1 | 6/2003 | Bech et al. | 114/230.2 |
| 6,651,577 | B1 | 11/2003 | Gates | 114/230.23 |
| 6,983,712 | B2 | 1/2006 | Cottrell et al. | 114/230.15 |

* cited by examiner

*Primary Examiner* — Lars A Olson

(57) ABSTRACT

A mooring system comprising a structure in a body of water; a vessel in the body of water; a first anchor in the body of water; a second anchor in the body of water; a first line connecting the first anchor and the vessel; a second line connecting the second anchor and the vessel; and a third line connecting the structure and the vessel.

8 Claims, 9 Drawing Sheets

VESSEL MOORING SYSTEMS AND METHODS

PRIORITY CLAIM

The present application claims priority of U.S. Provisional Patent Application No. 60/946,661 filed Jun. 27, 2007.

FIELD OF THE INVENTION

The invention relates generally to vessel mooring systems and methods. In particular, the invention relates to vessel mooring systems and methods to connect a vessel to another structure.

SUMMARY OF THE INVENTION

In one aspect, the invention relates to a mooring system comprising a structure in a body of water; a vessel in the body of water; a first anchor in the body of water; a second anchor in the body of water; a first line connecting the first anchor and the vessel; a second line connecting the second anchor and the vessel; and a third line connecting the structure and the vessel.

Advantages of the invention include one or more of the following:

Vessel mooring systems and methods with lower operating costs;

Vessel mooring systems and methods with lower capital costs;

Vessel mooring systems and methods with a lower risk of disconnecting;

Vessel mooring systems and methods which enable faster connection and disconnection;

Other aspects and/or advantages of the invention will be apparent from the following description and the appended claims.

DETAILED DESCRIPTION OF THE INVENTION

FIG. 1

Figure 1:
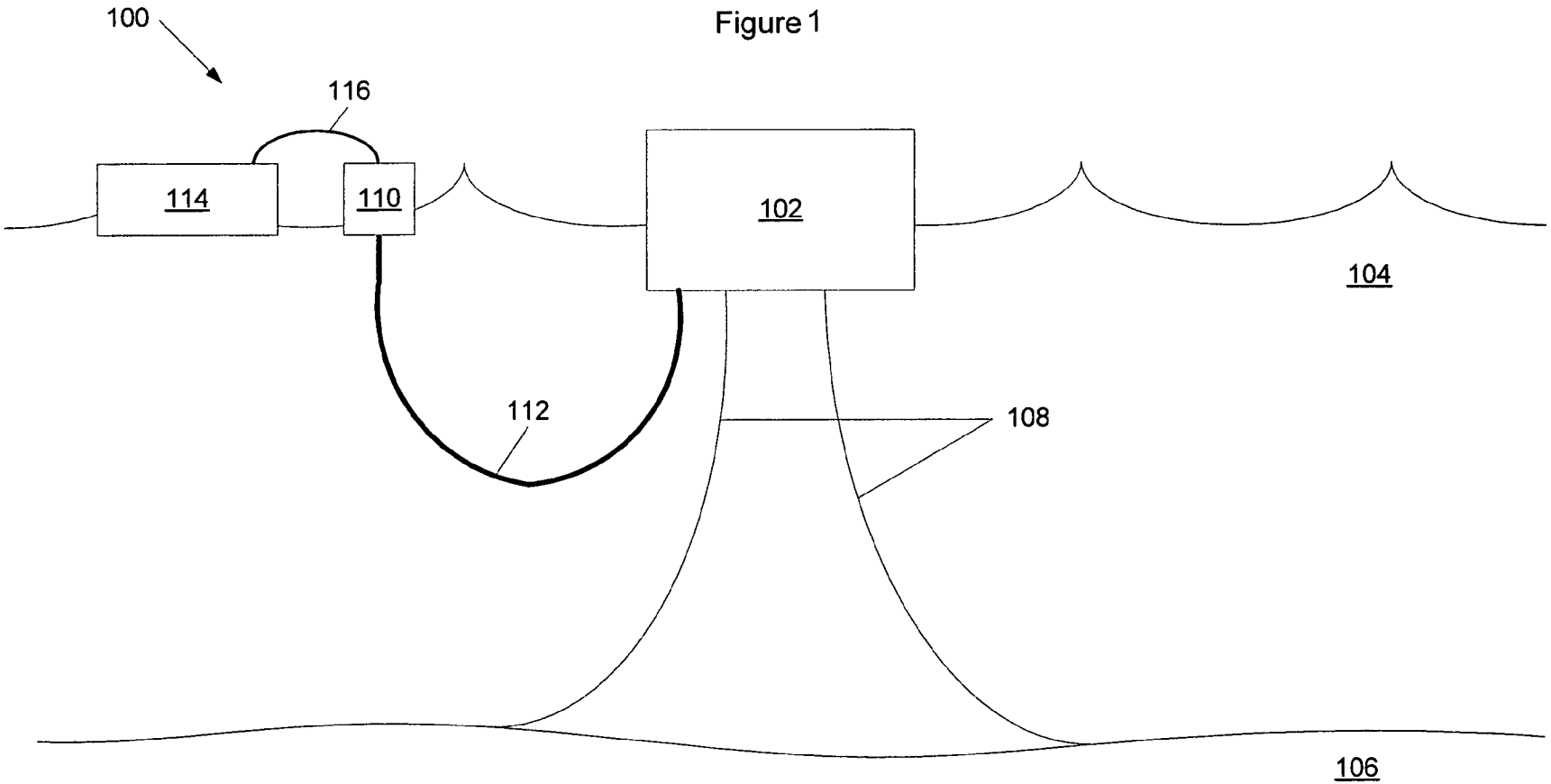
FIG. 1 is a side view of a vessel mooring system.

Referring now to FIG. 1, there is illustrated system 100. System 100 includes offshore structure 102 in body of water 104 with seafloor 106. As illustrated, structure 102 is a floating structure with catenary mooring lines 108. When it is desired to load or unload materials through a line 112, such as liquids or gases, vessel 114 connects to line 116, which is connected to buoy 110, which is connected to line 112. Buoy may also be provided with a hawser to connect the vessel 114 to buoy 110. Buoy 110 may be located a distance from structure 102 so that there is limited danger of contact between structure 102 and vessel 114. Although this approach provides for a safe transfer system between structure 102 and vessel 114, it requires the construction of line 112 and buoy 110. Buoy may have station-keeping capabilities by the use of one or more mooring lines.

FIG. 2

Figure 2:
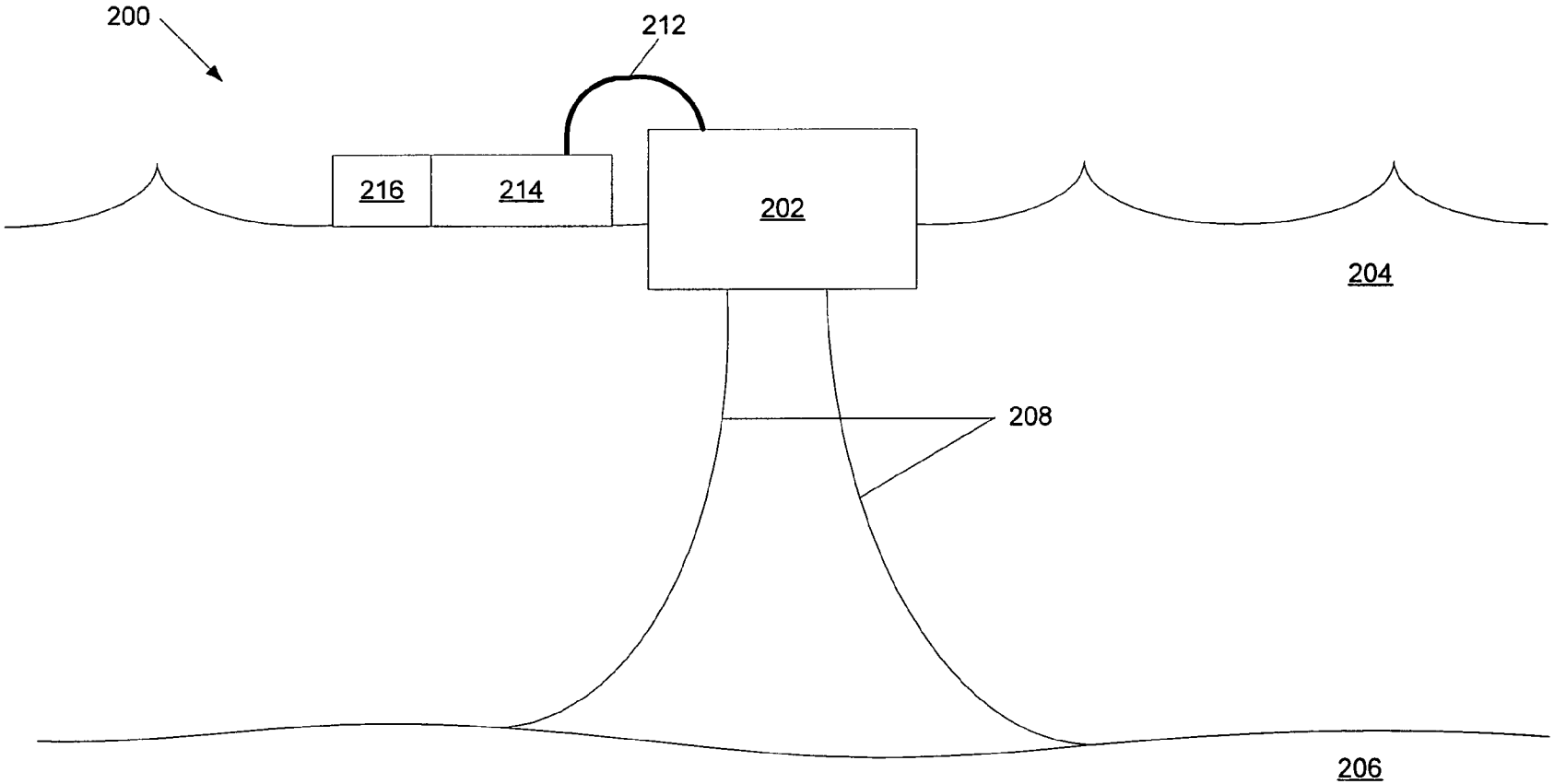
FIG. 2 is a side view of a vessel mooring system.

Referring now to FIG. 2, there is illustrated system 200. System 200 includes offshore structure 202 in body of water 204 with seafloor 206. As illustrated, structure 202 is a floating structure with catenary mooring lines 208. When it is desired to load or unload materials through line 212, such as liquids or gases, vessel 214 connects to line 212, and one or more other smaller vessels 216 may used to keep vessel 214 on station so that there is limited danger of contact between structure 202 and vessel 214. One or more lines, such as towing lines, may be used to connect vessels 214 and 216. Structure 202 may also be provided with a hawser to connect the vessel 214 to structure 202. Although this approach provides for a safe transfer system between structure 202 and vessel 214, it requires the use of one or more additional vessels 216.

U.S. Pat. No. 6,983,712 discloses a mooring arrangement between a floating storage body spread moored in deep water and a shuttle tanker, the arrangement including a single point buoyant member that is adapted for mooring a shuttle tanker in offloading position relative to a floating production, storage and offloading vessel (FPSO) with a link between the floating storage body and the single point buoyant member. One embodiment employs a submerged yoke, having one end rotatably coupled to a FPSO and a second end, supported by a buoy. A mooring hawser extends from the buoy to the shuttle tanker and product hoses connect the shuttle tanker with the FPSO and extend along the submerged yoke. The mooring buoy may be stationed by a hold-back mooring system and the FPSO or the tanker or both is provided with a traction device to move the tanker into loading position with respect to the FPSO. U.S. Pat. No. 6,983,712 is herein incorporated by reference in its entirety.

There is a need in the art for improved vessel mooring systems and methods. There is a need in the art for lower operating cost vessel mooring systems and methods. There is a need in the art for lower capital cost vessel mooring systems and methods.

FIGS. 3*a*-3*d*

Figure 3A:
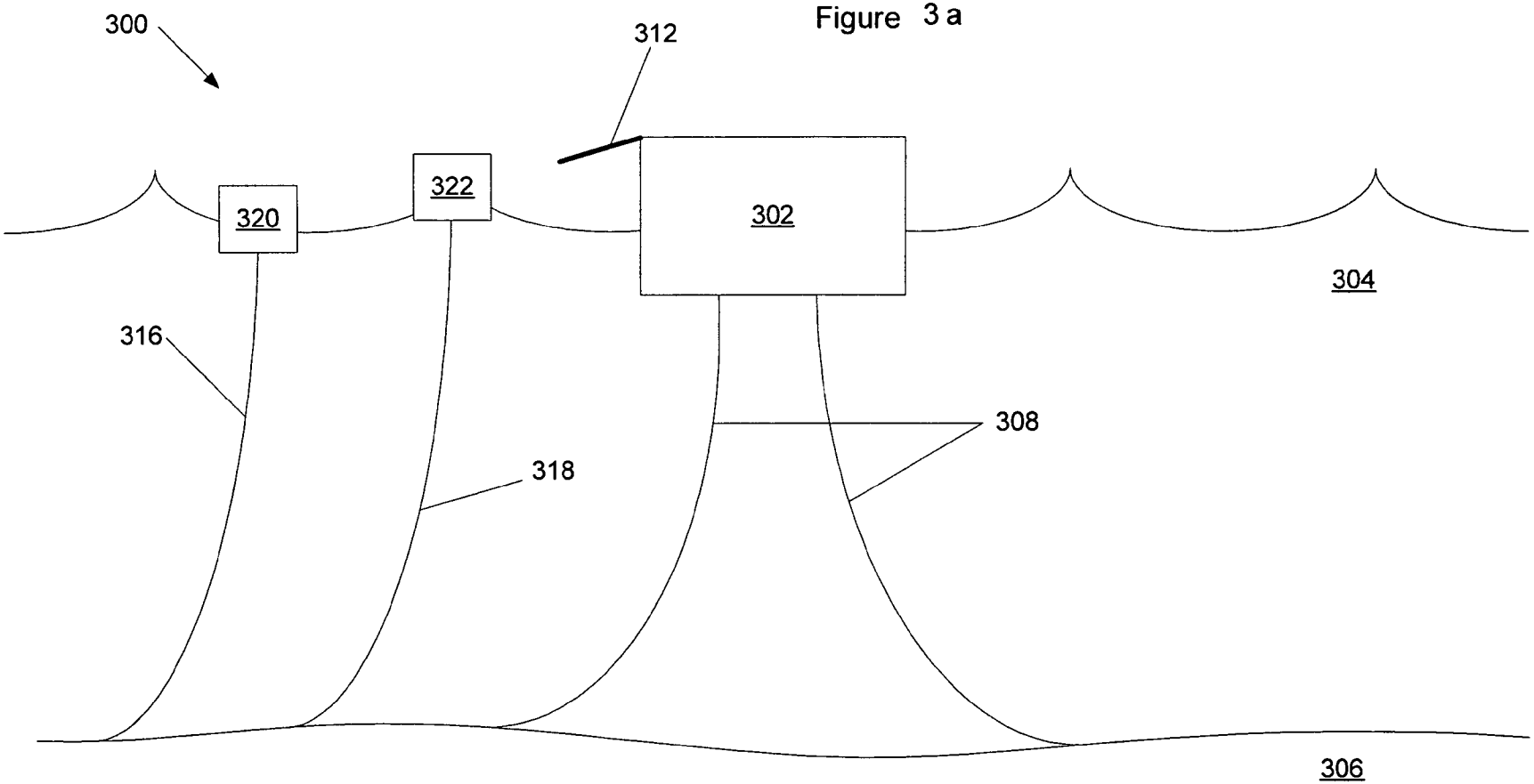
FIG. 3*a* is a side view of a vessel mooring system.

Referring now to FIG. 3*a*, there is illustrated system 300. System 300 includes offshore structure 302 in body of water 304 with seafloor 306. Structure 302 could be a floating structure such as an FPSO, a spar, a TLP, a ship, a semi-submersible, or other floating structures as are known in the art. Structure 302 could be connected to the sea floor with catenary or taut mooring lines. Alternatively, structure could be a fixed structure such as a pier, tower or platform which rests on the sea floor 306.

As illustrated, structure 302 is a floating structure with catenary mooring lines 308. When it is desired to load or unload materials from structure 302, such as liquids or gases, a vessel may be connected to lines 312, 316, and 318 to keep the vessel on station so that there is limited danger of contact between structure 302 and the vessel. Line 316 may be connected to line locator buoy 320, and line 318 may be connected to line locator buoy 322. Locator buoys 320 and 322 may be used by a vessel to locate the lines 316 and 318, and/or to guide the approach of the vessel towards structure 302.

Figure 3B:
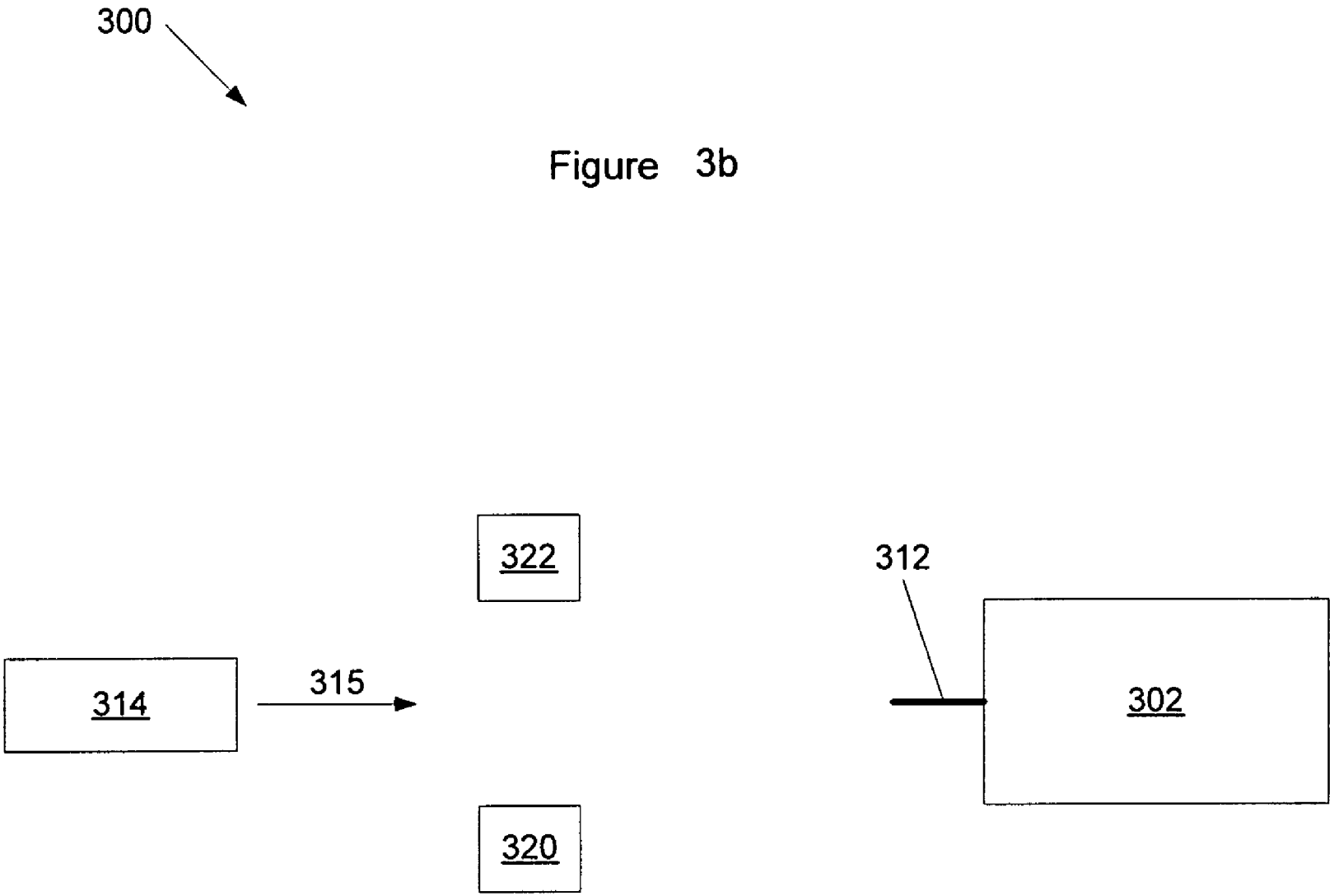
FIG. 3*b* is a top view of a vessel mooring system.

As illustrated in FIG. 3*b*, there is shown a top view of vessel 314, which may travel in direction of arrow 315 between buoys 320 and 322 towards structure 302 and line 312. As vessel 314 pulls alongside buoy 320, it can pull up buoy 320 and connect to line 316. Similarly, as vessel 314 pulls alongside buoy 322, it can pull up buoy 322 and connect to line 318. Then vessel 314 can approach and connect to line 312, and pull all the lines 316, 318, and 312 taut, then transfer to vessel 314 from structure 302, and/or from vessel 314 to structure 302.

Figure 3C:
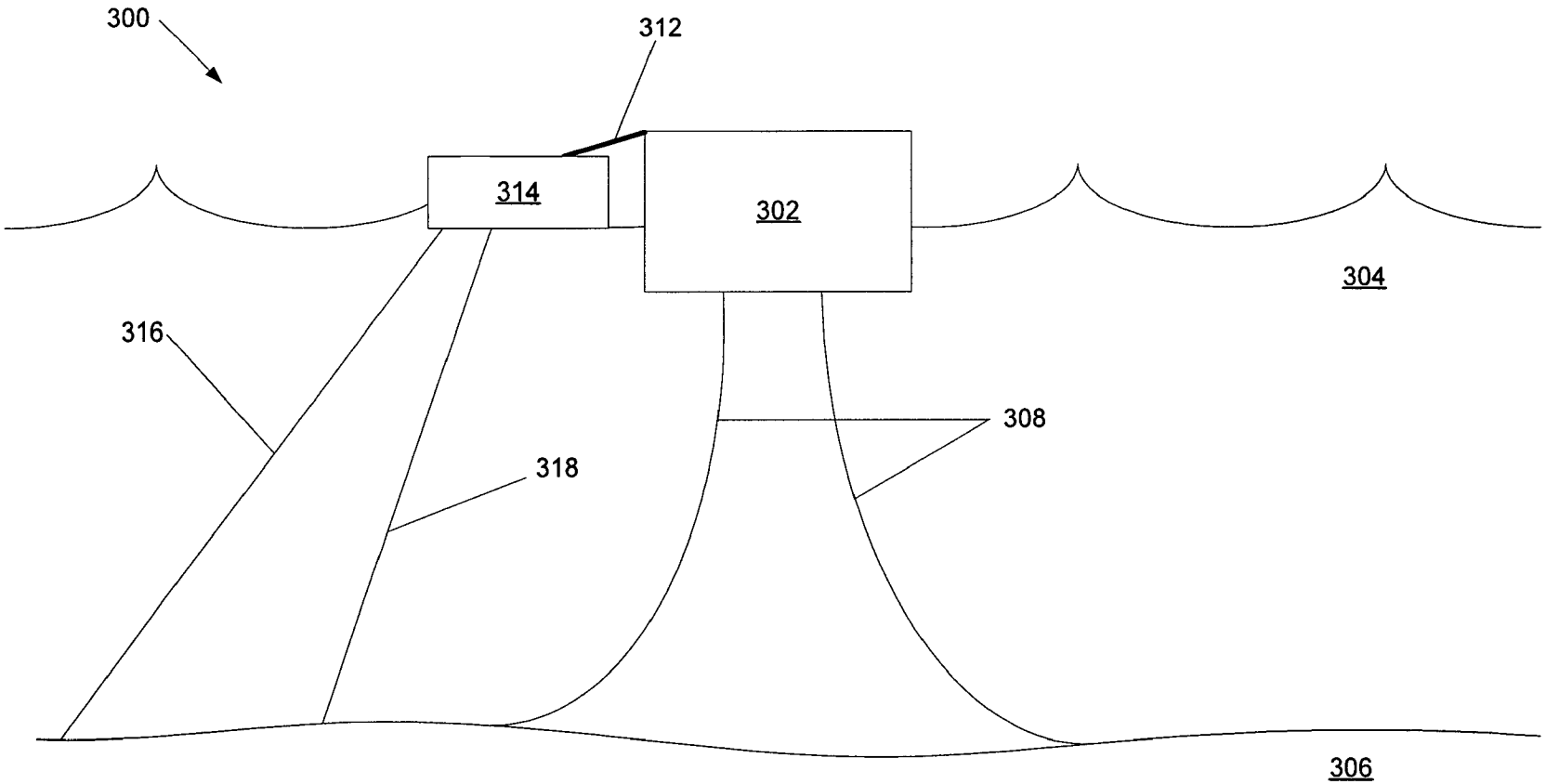
FIG. 3*c* is a side view of a vessel mooring system.
Figure 3D:
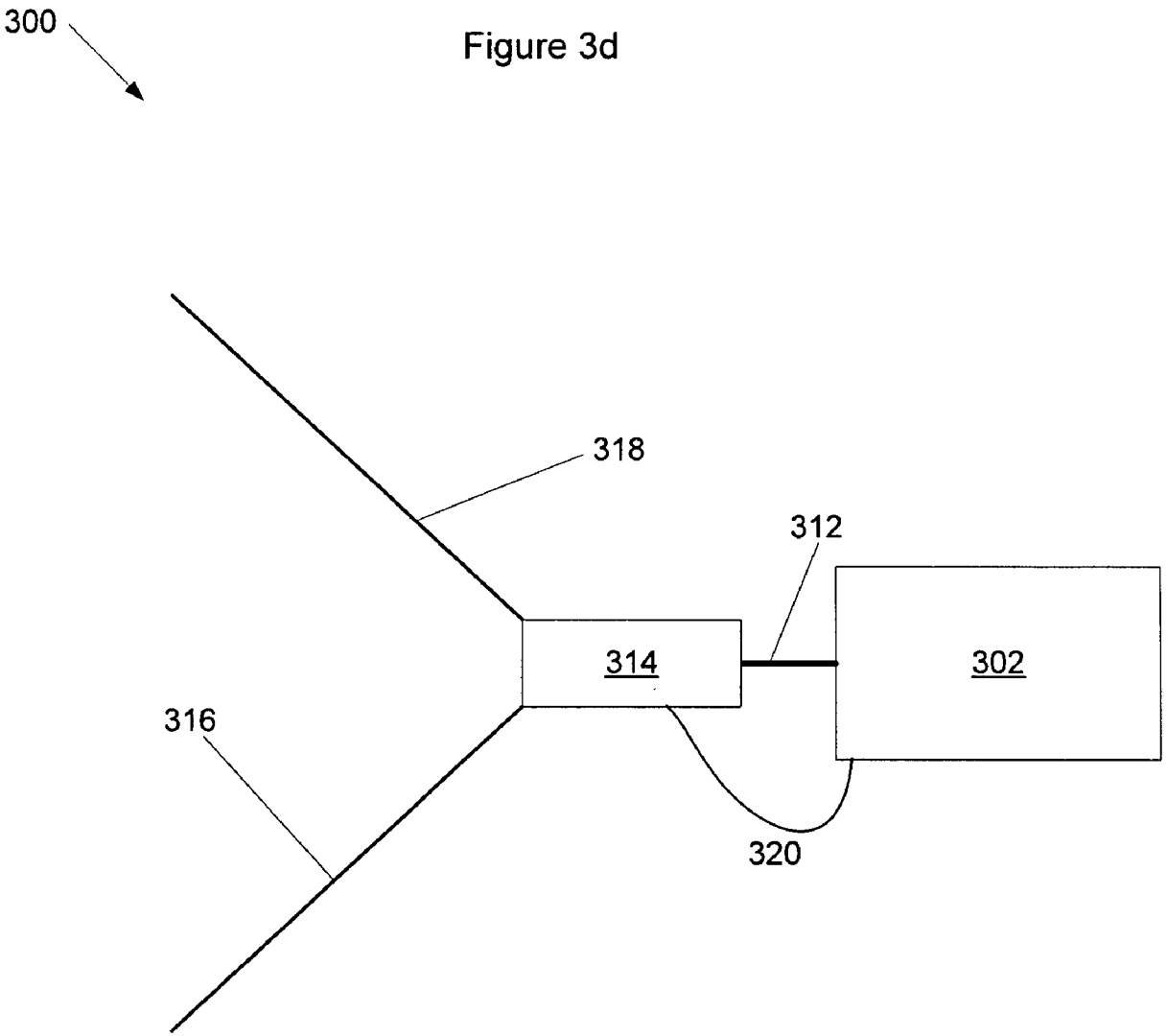
FIG. 3*d* is a top view of a vessel mooring system.

As illustrated in FIG. 3*c*, vessel 314 is shown connected to line 312, with all the lines 316, 318, and 312 taut, so that a transfer can be made to vessel 314 from structure 302, and/or from vessel 314 to structure 302. FIG. 3*d* shows a top view of vessel 314 connected to lines 316, 318, and 312, with hose 320 being used to transfer fluids to and/or from structure 302 to and/or from vessel 314.

FIG. 4

Figure 4:
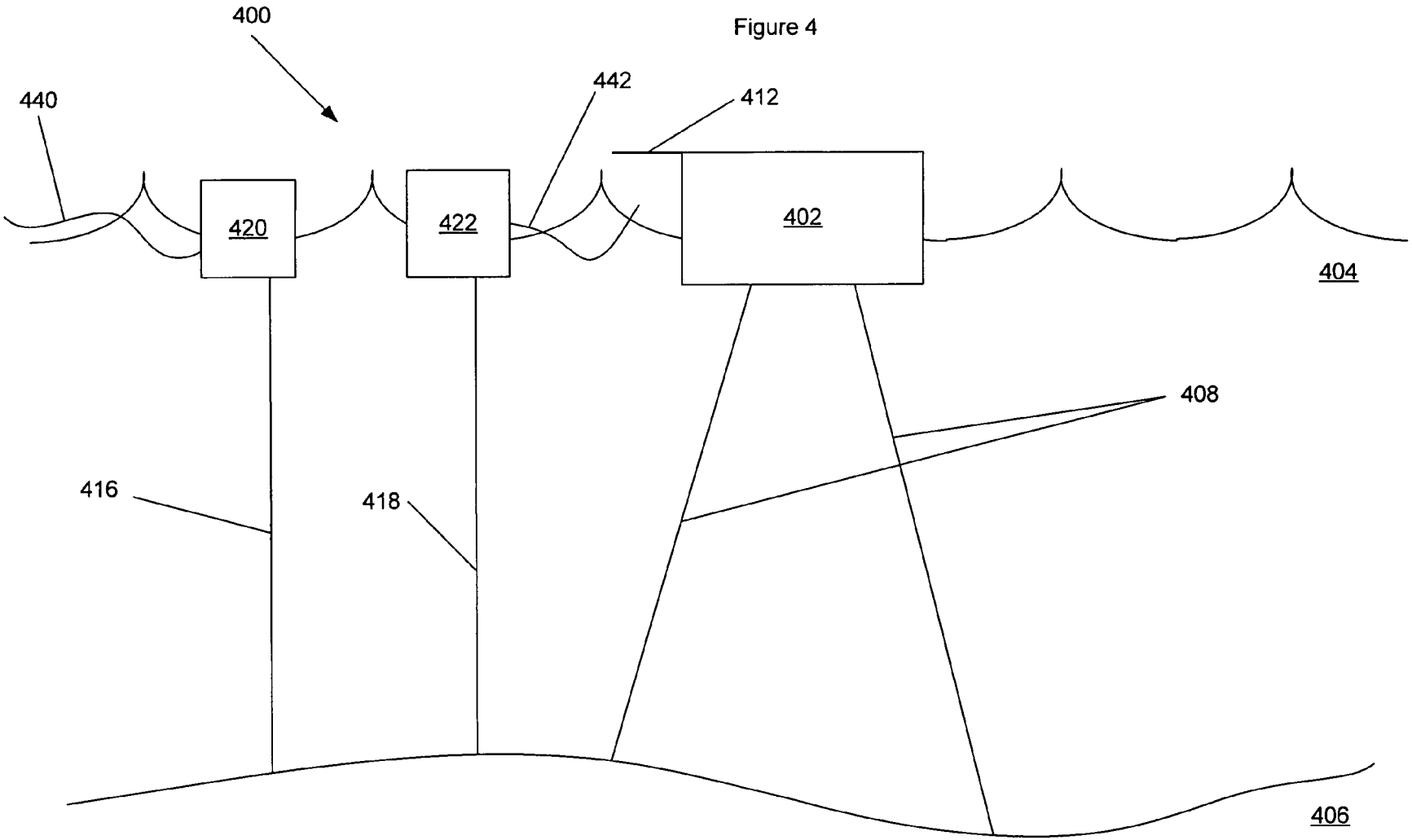
FIG. 4 is a side view of a vessel mooring system.

Referring now to FIG. 4, there is illustrated system 400. System 400 includes offshore structure 402 in body of water 404 with seafloor 406. Structure 402 could be a floating structure such as an FPSO, a spar, a TLP, a ship, a semi-submersible, or other floating structures as are known in the art. Structure 402 could be connected to the sea floor with catenary or taut mooring lines. Alternatively, structure could be a fixed structure such as a pier, tower or platform which rests on the sea floor 406.

As illustrated, structure 402 is a floating structure with taut mooring lines 408. When it is desired to load or unload materials from structure 402, such as liquids or gases, a vessel may be connected to lines 412, 440, and 442 to keep the vessel on station so that there is limited danger of contact between structure 402 and the vessel. Line 416 may be connected to buoy 420, and line 418 may be connected to buoy 422. Buoys 420 and 422 may be used by a vessel to locate the lines 440 and 442, and/or to guide the approach of the vessel towards structure 402.

Buoy 420 may be used to keep line 416 taut, while line 440 is slack. Likewise, buoy 422 may be used to keep line 418 taut, while line 442 is slack. In operation, a vessel approaches buoy 420 and locates line 440 and attaches it to the vessel. The vessel then approaches buoy 422 and locates line 442 and attaches it to the vessel. Then the vessel approaches line 412 and attaches it to the vessel. Structure 402 and/or the vessel may be provided with a winch or other tightening mechanism to add tension to line 412 and pull the vessel to a desired location, which also tightens lines 440 and 442 to keep the vessel on station.

After the completion of the operations, line 412 may be loosened, and all of the lines 412, 440, and 442 disconnected from the vessel, so that the vessel can leave the location after loading and/or unloading.

FIG. 5

Figure 5:
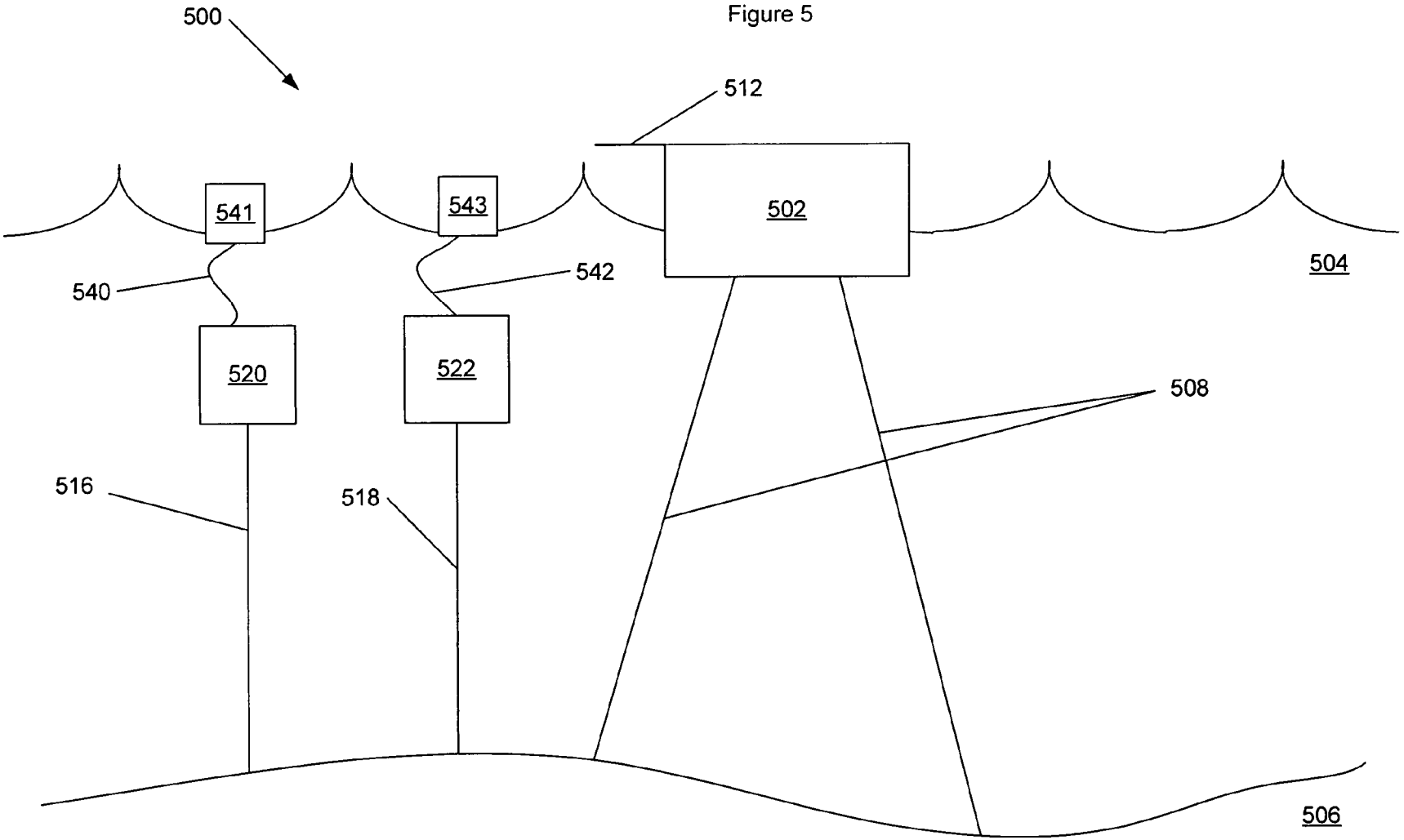
FIG. 5 is a side view of a vessel mooring system.

Referring now to FIG. 5, there is illustrated system 500. System 500 includes offshore structure 502 in body of water 504 with seafloor 506. Structure 502 could be a floating structure such as an FPSO, a spar, a TLP, a ship, a semi-submersible, or other floating structures as are known in the art. Structure 502 could be connected to the sea floor with catenary or taut mooring lines. Alternatively, structure could be a fixed structure such as a pier, tower or platform which rests on the sea floor 506.

As illustrated, structure 502 is a floating structure with taut mooring lines 508. When it is desired to load or unload materials from structure 502, such as liquids or gases, a vessel may be connected to lines 512, 540, and 542 to keep the vessel on station so that there is limited danger of contact between structure 502 and the vessel. Line 516 may be connected to buoy 520, and line 518 may be connected to buoy 522. Line 540 may be connected between buoys 520 and 541, and line 542 may be connected between buoys 522 and 543. Buoys 541 and 543 may be used by a vessel to locate the lines 540 and 542, and/or to guide the approach of the vessel towards structure 502.

Buoy 520 may be used to keep line 516 taut, while line 540 is slack since line 540 is longer than the vertical distance between buoys 520 and 541. Likewise, buoy 522 may be used to keep line 518 taut, while line 542 is slack since line 542 is longer than the vertical distance between buoys 522 and 543.

In operation, a vessel approaches buoy 541 and locates line 540 and attaches line 540 to the vessel. The vessel then approaches buoy 543 and locates line 542 and attaches line 542 to the vessel. Then the vessel approaches line 512 and attaches it to the vessel. Structure 502 and/or the vessel may be provided with a winch or other tightening mechanism to add tension to line 512 and pull the vessel to a desired location, which also tightens lines 540 and 542 to keep the vessel on station. Alternatively, a smaller vessel may be used to locate the lines, and pull them to the larger vessel to be attached and tightened.

After the completion of the operations, line 512 may be loosened, and all of the lines 512, 540, and 542 disconnected from the vessel, so that the vessel can leave the location after loading and/or unloading.

FIG. 6

Figure 6:
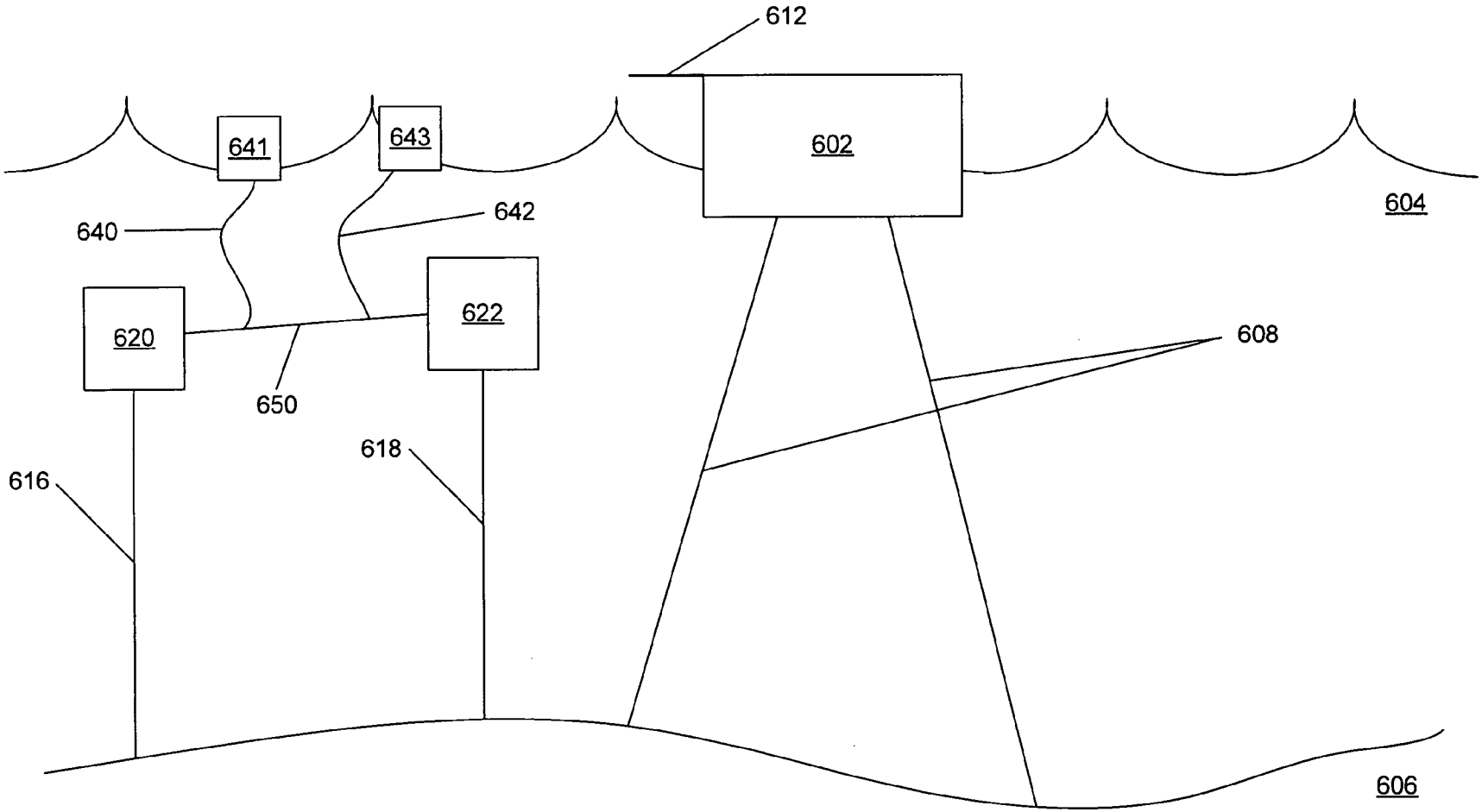
FIG. 6 is a side view of a vessel mooring system.

Referring now to FIG. 6, there is illustrated system 600. System 600 includes offshore structure 602 in body of water 604 with seafloor 606. Structure 602 could be a floating structure such as an FPSO, a spar, a TLP, a ship, a semi-submersible, or other floating structures as are known in the art. Structure 602 could be connected to the sea floor with catenary or taut mooring lines. Alternatively, structure could be a fixed structure such as a pier, tower or platform which rests on the sea floor 606.

As illustrated, structure 602 is a floating structure with taut mooring lines 608. When it is desired to load or unload materials from structure 602, such as liquids or gases, a vessel may be connected to lines 612, 640, and 642 to keep the vessel on station so that there is limited danger of contact between structure 602 and the vessel. Line 616 may be connected to buoy 620, and line 618 may be connected to buoy 622. Line 650 may be connected between buoys 620 and 622. Line 640 may be connected between line 650 and buoy 641, and line 642 may be connected between line 650 and buoy 643. Line 640 may be connected to line 650 at a point closer to buoy 620 than 622. Line 642 may be connected to line 650 at a point closer to buoy 622 than 620. Buoys 641 and 643 may be used by a vessel to locate the lines 640 and 642, and/or to guide the approach of the vessel towards structure 602.

Buoy 620 may be used to keep line 616 taut, while line 640 is slack since line 640 is longer than the vertical distance between line 650 and buoy 641. Likewise, buoy 622 may be used to keep line 618 taut, while line 642 is slack since line 642 is longer than the vertical distance between line 650 and buoy 643.

In operation, a vessel approaches buoy 641 and locates line 640 and attaches line 640 to the vessel. The vessel then approaches buoy 643 and locates line 642 and attaches line 642 to the vessel. Then the vessel approaches line 612 and attaches it to the vessel. Structure 602 and/or the vessel may be provided with a winch or other tightening mechanism to add tension to line 612 and pull the vessel to a desired location, which also tightens lines 640 and 642 to keep the vessel on station. Alternatively, a smaller vessel may be used to locate the lines, and pull them to the larger vessel to be attached and tightened.

After the completion of the operations, line 612 may be loosened, and all of the lines 612, 640, and 642 disconnected from the vessel, so that the vessel can leave the location after loading and/or unloading.

Illustrative Embodiments

In one embodiment, there is disclosed a mooring system comprising a structure in a body of water; a vessel in the body of water; a first anchor in the body of water; a second anchor in the body of water; a first line connecting the first anchor and the vessel; a second line connecting the second anchor and the vessel; and a third line connecting the structure and the vessel. In some embodiments, the system also includes a buoy attached to the first line. In some embodiments, the buoy is submerged. In some embodiments, the system also includes a chord line connecting the first line and the second line. In some embodiments, the system also includes a hose connecting the structure and the vessel.

In one embodiment, there is disclosed a method of mooring a vessel comprising locating a first line and connecting the first line to the vessel at a first end and to a permanent anchoring mechanism at the second end; locating a second line and connecting the second line to the vessel at a first end and to a permanent anchoring mechanism at the second end; and connecting a third line between the vessel and an offshore structure. In some embodiments, the method also includes tightening the third line. In some embodiments, tightening the third line further comprises pulling the first line and the second line taut. In some embodiments, the method also includes attaching a buoy to the first end of the first line. In some embodiments, the method also includes attaching a buoy to the first end of the second line. In some embodiments, the first line is attached to an aft portion of the vessel on a port side. In some embodiments, the second line is attached to an aft portion of the vessel on a starboard side. In some embodiments, the third line is attached to a bow portion of the vessel.

Buoys 320 and 322, 420 and 422, 520 and 522, and/or 620 and 622 may be from about 500 meters to about 3000 meters apart from each other, for example from about 1000 meters to about 2000 meters apart from each other.

Buoys 320 and 322, 420 and 422, 520 and 522, and/or 620 and 622 may be from about 500 meters to about 5000 meters apart from structure 302, 402, 502, and/or 602, for example from about 1500 meters to about 3000 meters apart from the structure.

Lines 316, 318, 416, 418, 516, 518, 616, and/or 618 may be connected to the sea floor with mooring piles, vertical load anchors, and/or other anchoring systems as are known in the art.

Vessel 314 may be a Aframax, Suezmax, or VLCC capacity vessel. Vessel 314 may have a liquid capacity of at least about 0.75 million barrels, or at least about 1 million barrels, or at least about 2 million barrels.

Buoys 520, 522, 620, and/or 622 may be submerged to a depth of at least about 30 meters, for example from about 40 to about 80 meters.

A workboat may be used to attach and/or disconnect lines to the vessel.

Lines 318 and 318 when taut and connected to vessel 314 have an angle from about 60 to about 120 degrees between them, for example from about 75 to about 115 degrees.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

That which is claimed is:

1. A mooring system comprising:

a structure in a body of water;

a vessel in the body of water;

a first vertical load anchor which is connected to a first submerged buoy by a substantially vertical first anchor line in the body of water;

a second vertical load anchor which is connected to a second submerged buoy by a substantially vertical second anchor line in the body of water;

a first line connecting the first submerged buoy and the vessel;

a second line connecting the second submerged buoy and the vessel;

a third line connecting the structure and the vessel;

a chord line connecting the first line and the second line; and a tightening mechanism on at least one of the structure and the vessel, the tightening mechanism connected to the third line to pull the vessel to a desired location.

2. The mooring system of claim 1, further comprising a hose connecting the structure and the vessel.

3. A method of mooring a vessel comprising:

locating a first line and connecting the first line to the vessel at a first end and to first submerged buoy which is connected by a substantially vertical first anchor line to a vertical load anchor at the second end;

locating a second line and connecting the second line to the vessel at a first end and to second submerged buoy which is connected by a substantially vertical second anchor line to a vertical load anchor at the second end;

connecting the first line and the second line with a chord line; and connecting a third line between the vessel and an offshore structure;

connecting the third line to a tightening mechanism on at least one of the structure and the vessel; and pulling the vessel to a desired location with the tightening mechanism.

4. The method of claim 3, further comprising tightening the third line.

5. The method of claim 4, wherein tightening the third line further comprises pulling the first line and the second line taut.

6. The method of claim 3, wherein the first line is attached to an aft portion of the vessel on a port side.

7. The method of claim 3, wherein the second line is attached to an aft portion of the vessel on a starboard side.

8. The method of claim 3, wherein the third line is attached to a bow portion of the vessel.

* * * * *